United States Patent [19]

Gerber

[11] 4,205,835

[45] Jun. 3, 1980

[54] BRISTLE BED FOR VACUUM TABLE

[75] Inventor: Heinz J. Gerber, West Hartford, Conn.

[73] Assignee: Gerber Garment Technology, Inc., South Windsor, Conn.

[21] Appl. No.: 966,213

[22] Filed: Dec. 4, 1978

Related U.S. Application Data

[63] Continuation of Ser. No. 796,605, May 13, 1977, abandoned.

[51] Int. Cl.[2] ..... B26D 7/20

[52] U.S. Cl. ..... 269/289 R; 83/451; 83/658; 83/925 CC; 269/21

[58] Field of Search ..... 269/289 R, 21; 83/925 CC, 451, 658; 15/159-162, 268; 273/195 A

[56] References Cited

U.S. PATENT DOCUMENTS

| | | | |
|---|---|---|---|
| 245,150 | 8/1881 | Fowler | 83/925 CC X |
| 802,685 | 10/1905 | Debacher | 15/159 R |
| 2,023,307 | 12/1935 | Burton | 273/195 A |
| 3,046,824 | 7/1962 | Mohr | 83/658 |
| 3,350,092 | 10/1967 | Maki | 273/195 A X |
| 3,467,391 | 9/1969 | Elesh | 273/195 A |
| 3,495,492 | 2/1970 | Gerber et al. | 83/925 CC X |
| 3,598,006 | 8/1971 | Gerber et al. | 269/21 X |
| 3,711,082 | 1/1973 | Seidenfaden | 269/21 |
| 3,715,945 | 2/1973 | Mochizuki | 83/658 X |
| 3,780,607 | 12/1973 | Gerber | 83/925 CC X |
| 3,815,923 | 6/1974 | Goduto | 15/159 A X |
| 3,848,327 | 11/1974 | Gerber et al. | 83/925 CC X |
| 3,942,781 | 3/1976 | Gerber | 83/925 CC X |

*Primary Examiner*—Frank T. Yost

*Attorney, Agent, or Firm*—McCormick, Paulding & Huber

[57] ABSTRACT

A vacuum table has a base and a bristle bed which includes a bristle mat formed from a plurality of molded bristle blocks mounted in closely spaced relation within the table base. Each bristle block has a base portion and a multiplicity of straight or tapered bristles which project upwardly therefrom and cooperate to define a penetrable support surface. Apertures in the bases of the blocks and/or spaces between marginal edges of adjacent blocks define airflow passageways through the mat which communicate with a vacuum source for inducing airflow in downward directions generally parallel to the bristles. The bristle blocks may be supported on a grid or may be self supported.

32 Claims, 17 Drawing Figures

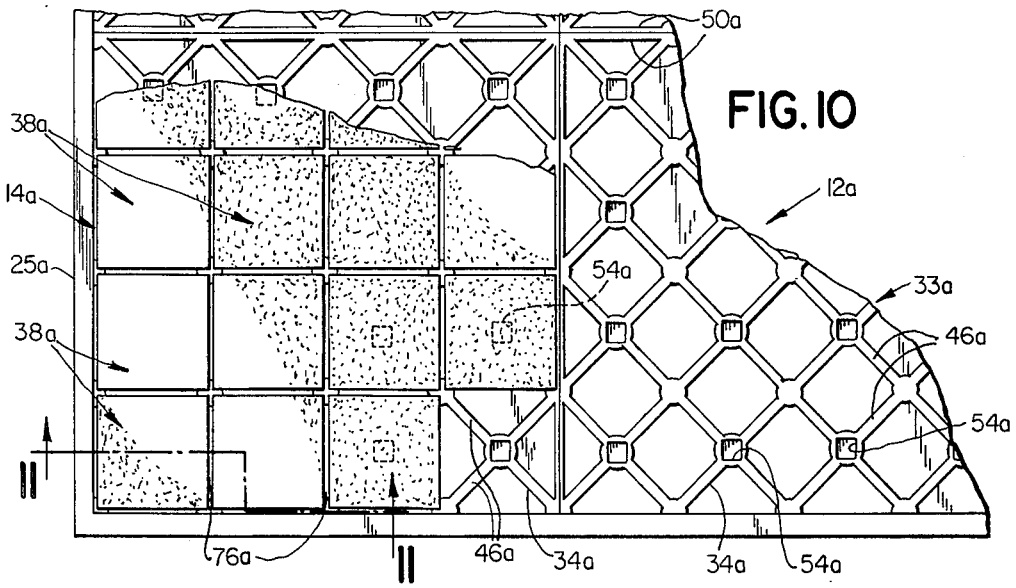
FIG. 10
FIG. 11
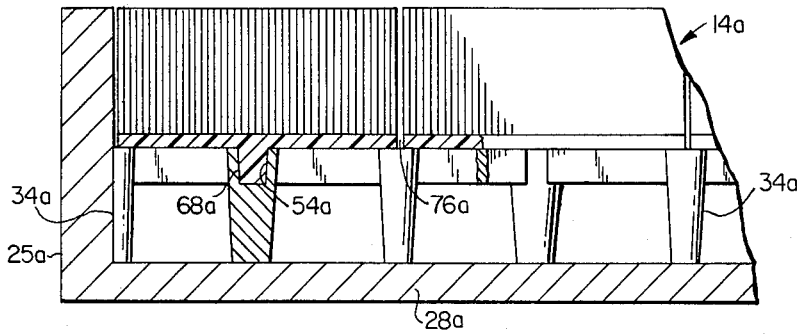
FIG. 13
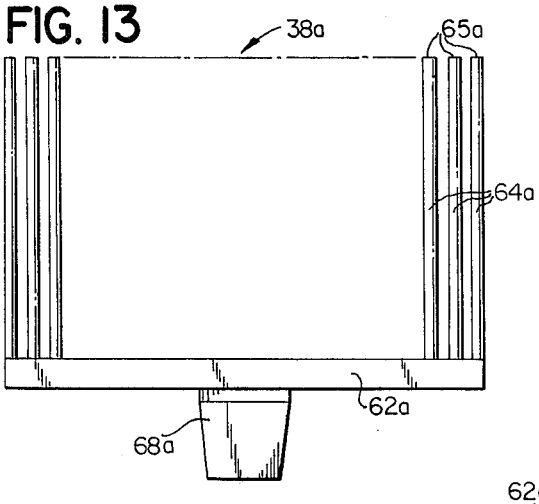
FIG. 12
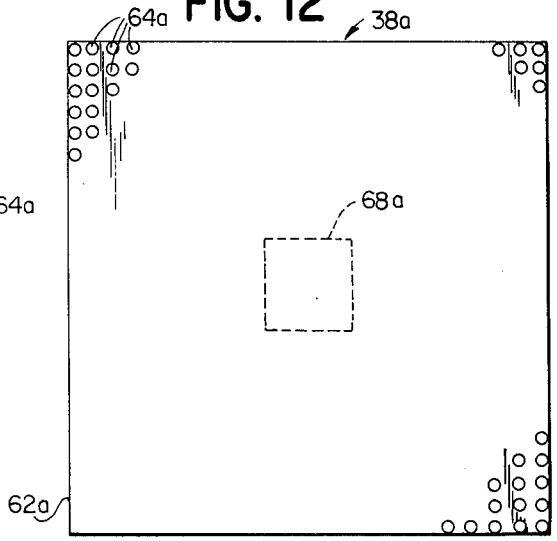

BRISTLE BED FOR VACUUM TABLE

This is a continuation of application Ser. No. 796,605 filed May 13, 1977, now abandoned.

BACKGROUND OF THE INVENTION

This invention relates in general to vacuum apparatus for compacting, rigidizing and/or holding fabric and the like while being cut or otherwise worked and deals more particularly with improvements in bristle beds for vacuum tables. Heretofore vacuum tables have been available which include beds of penetrable bristles which define generally horizontally disposed work surfaces for supporting material to be held firmly in place by vacuum. Such apparatus is disclosed in U.S. Pat. No. 3,765,289 to Gerber et al, issued Jan. 15, 1971 and assigned to the assignee of the present invention. A typical apparatus of this type includes a bristle bed formed from a plurality of bristle blocks. Each block has a gas impermeable base portion and a gas permeable body portion defined by a multiplicity of bristles which project from the base portion. One or more vacuum channels which communicate with a vacuum chamber are arranged along one or more sides of the bed in communication with the gas permeable body portions of the bristle blocks above the bases of the blocks to induce airflow from the bed in transverse directions relative to the bristles and toward the vacuum channels. In such a vacuum apparatus for a cloth cutting machine or the like, it is generally desirable that the bristle bed have a high bristle density to reduce lateral bristle deflection which causes valleys to occur between the bristles and into which sheet material supported on the vacuum table may be drawn. However, high bristle density tends to restrict transverse airflow through the bristle bed and toward the laterally disposed vacuum channels. Air which enters the cut formed in the sheet material supported on the bristle bed must flow through the relatively dense bed of bristles to the vacuum channels if holding pressure is to be maintained in the vicinity of the cut. If such a vacuum table installation has a relatively wide bed, vacuum channels may be provided at laterally opposite edges of the bed to reduce the length of the airflow paths from the central regions of the bed whereby to increase vacuum holding efficiency in central regions of the table. However, some holding efficiency is lost due to the relatively long airflow paths through the dense bed of bristles.

It is the general aim of the present invention to provide an improved bristle bed for a vacuum table wherein the length of airflow paths through the bed is minimized for increased compacting, rigidizing and holding efficiency. A further aim of the invention is to provide an improved durable bristle bed for low cost manufacture and which may be economically repaired or replaced.

SUMMARY OF THE INVENTION

In accordance with the present invention, a bristle bed for a vacuum apparatus for compacting, rigidizing and/or holding fabric and the like while being cut or otherwise worked comprises a bristle mat which includes a plurality of bristle blocks. Each bristle block has a base and a plurality of flexible bristles which project therefrom. The bristle blocks are supported with the bases thereof disposed in a common plane to define a mat base and the free ends of the bristles disposed in another common plane to define a support surface. Openings are provided in the bristle mat between the various bristle blocks for communication with a vacuum chamber.

BRIEF DESCRIPTION OF THE DRAWINGS

FIG. 10 is a fragmentary plan view of another vacuum table embodying the present invention.

FIG. 11 is a somewhat enlarged sectional view taken generally along the line 11—11 of FIG. 10.

FIG. 12 is a somewhat further enlarged plan view of another bristle block.

FIG. 13 is a side elevational view of the bristle block of FIG. 12.

DETAILED DESCRIPTION OF PREFERRED EMBODIMENT

Figure 1:
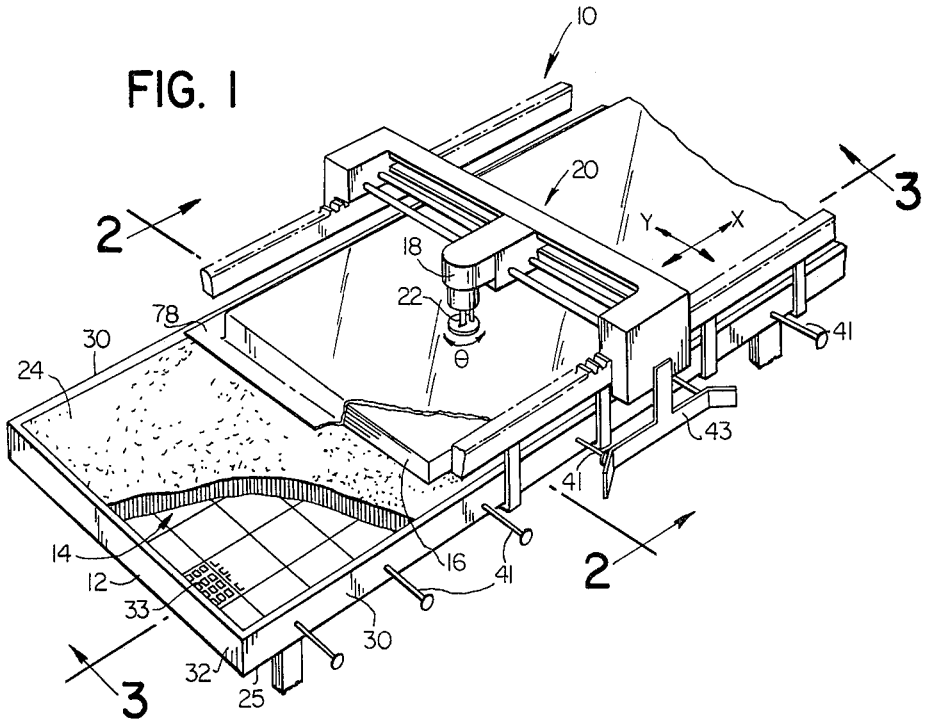
FIG. 1 is a fragmentary perspective view of an apparatus for cutting sheet material which includes a vacuum table embodying the present invention.

Turning now to the drawings and referring particularly to FIG. 1, an apparatus for cutting sheet material and indicated generally by the reference numeral 10 includes a zoned vacuum table 12 which has a bristle bed indicated generally at 14 and embodying the present invention. The apparatus 10 is particularly adapted for cutting a sheet material layup 16 which comprises a plurality of sheets of limp fabric or like material arranged in vertically stacked relation and held in fixed position on and by the vacuum table 12. The apparatus 10 further includes a cutting mechanism 18 mounted on a movable carriage assembly indicated generally at 20 and carrying a blade 22. The carriage assembly 20 is supported on the table to move the cutting mechanism 18 in longitudinal (X) and transverse (Y) coordinate directions relative to the table surface with the blade 22 in cutting engagement with the layup 16 to cut patterns from the layup in response to control signals received from a programable controller (not shown). The blade 22 has a reciprocating cutting stroke and is adapted for rotation about its own axis in a direction indicated by the arrow $\theta$ in response to signals from the controller. During at least a portion of its stroke the blade 16 penetrates the upper or work support surface of the table 12, the latter surface being indicated by the numeral 24 and defined by the bristle bed 14. A further disclosure of sheet material cutting apparatus of the aforedescribed general type is contained in the aforementioned patent to Gerber et al and the several patents mentioned therein which are hereby adopted by reference as a part of the present disclosure.

The vacuum holding apparatus or vacuum table 12 is zoned and has a base 25 which contains the bristle bed 14 and which cooperates therewith to define a longitudinal series of contiguous vacuum chambers 26, 26. The table base is generally rectangular and includes a bottom wall 28, side walls 30, 30 and end walls 32, 32 (one shown). The bristle bed 14 is disposed within the base 24 and comprises a grid plate indicated generally at 33, best shown in FIGS. 1 and 4, and formed from a plurality of contiguously arranged grid modules 34, 34, which define a generally horizontally disposed bristle block supporting surface 36 and which cooperates with the bottom wall 28 and the side walls 30, 30 to define the vacuum chamber 26, 26, as will be hereinafter further discussed. The bristle bed 14 further includes a plurality of individual bristle blocks 38, 38 which cooperate in assembly to define a bristle mat. Each bristle block 38 has a base portion the edges of which are scalloped, and a plurality of upwardly projecting bristles. The bristle blocks 38, 38 are supported with the base portions thereof in adjacent closely spaced relation to define a mat base which has air openings therethrough defined by spaces between adjacent bristle blocks. Additional air passageways may be formed in the base portions of the various bristle blocks. The bristle blocks 38, 38 are releasably retained in assembly with the grid plates 34, 34. The base portions of the various bristle blocks are disposed in a common plane on the support surface 36 defined by the grid plates. The free ends of the various bristles are disposed in another common plane to define the generally horizontal work support 24. Vacuum may be drawn from one or both sides or from the bottom of the table 12. In the illustrated cutting apparatus 10, slide valves 37, 37, disposed within the chambers 26, 26, function to open or close passageways which lead to a vacuum duct 39 which extends along the bottom of the table 12 and which is connected to a vacuum source 45. The latter valves are opened by actuating rods 41, 41 which are disposed in the path of a valve actuator 43 mounted on the carriage assembly 20 to travel therewith, as shown in FIG. 1.

Figure 4:
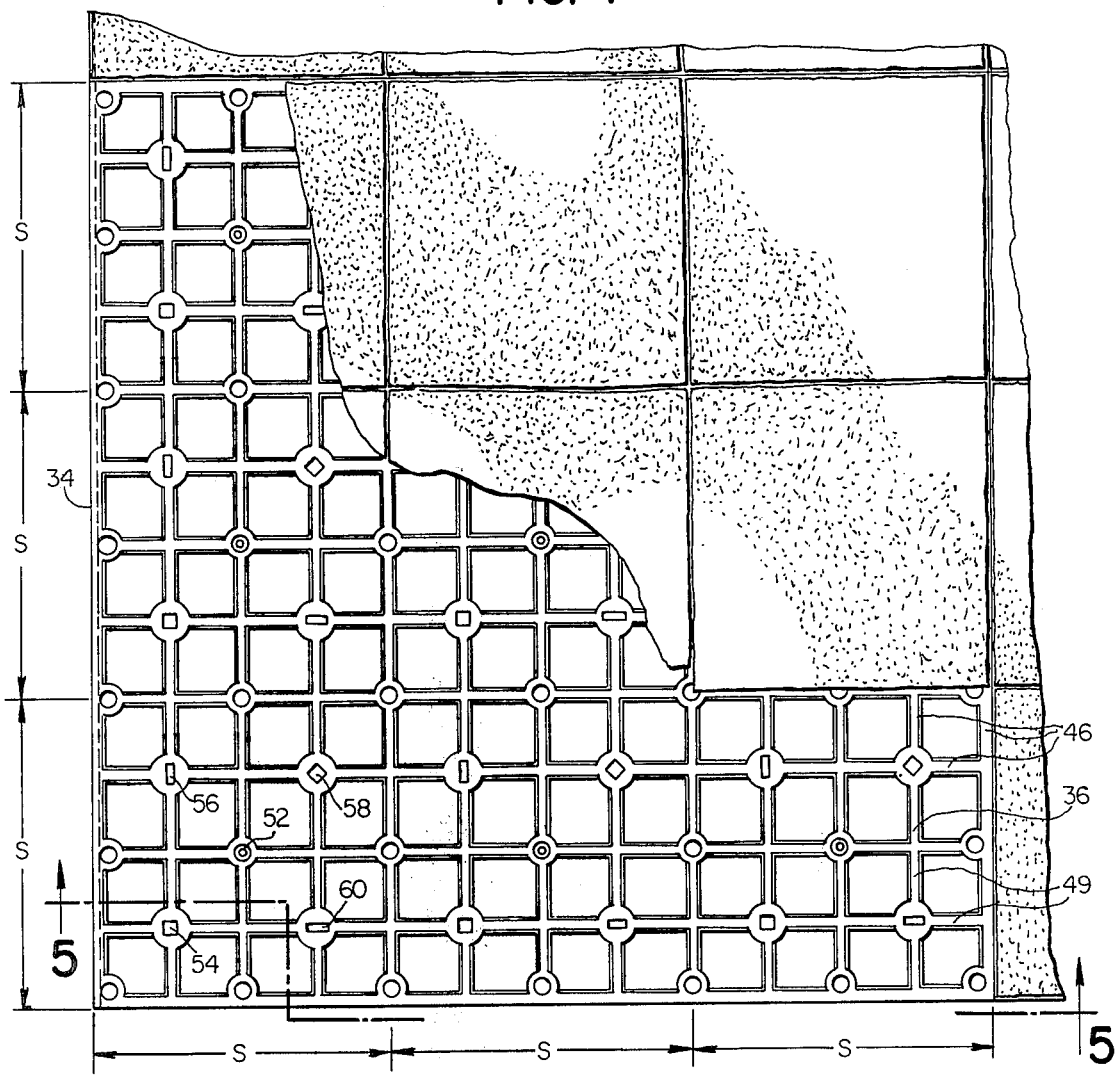
FIG. 4 is a somewhat enlarged fragmentary plan view of a portion of the bristle bed of the apparatus of FIG. 1.
Figure 5:
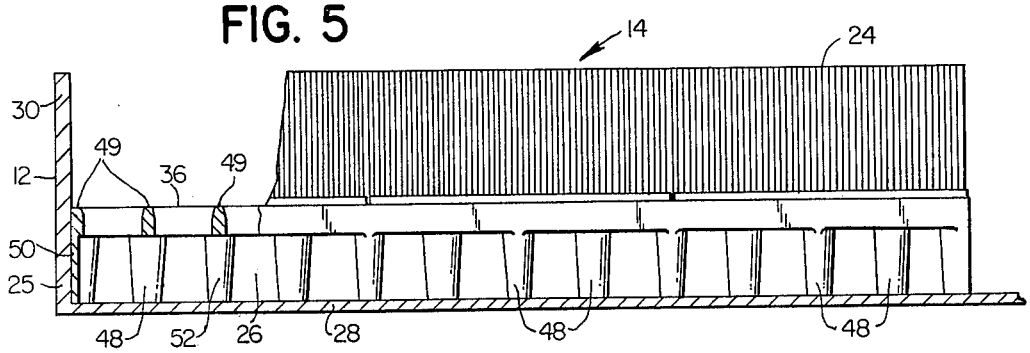
FIG. 5 is a fragmentary sectional view taken generally along the line 5—5 of FIG. 4.

Considering the bristle bed 14 in further detail, the grid modules 34, 34 which comprise the grid plate 33 are arranged in end-to-end relation within the table base 25. Each grid module 34 is adapted to support and releasably retain a plurality of bristle blocks 38, 38 in position within the table base 25. A typical grid module, best shown in FIGS. 4 and 5 comprises a unitary structure molded from plastic material which has a grid pattern formed by a plurality of integral intersecting bars 46, 46. Integral hollow legs 48, 48 project downwardly from the bars 46, 46 at points of intersection to engage the bottom wall 28 and support the grid module 34 within the table base with its supporting surface 36 disposed above and in generally parallel relation to the bottom wall. The upper end portions of the bars 46, 46 taper upwardly and inwardly, as viewed in FIG. 5 and terminate at relatively narrow lands 49, 49 which define the upper surface 36. A skirt or wall 50 extends along one side of the grid module 34 between the upper surface 36 and the lower ends of the various legs. The illustrated grid module 34 is adapted to support and retain a group of nine bristle blocks 38, 38 and is divided into nine substantially identical contiguous sections S, S, as viewed from above and as best shown in FIG. 5. A typical grid section S has a hollow leg at 52 at its center for receiving a fastener to secure the grid module to the bottom wall 28. The legs located at the four points of intersections which surround the central leg 52 define connector apertures respectively indicated at 54, 56, 58 and 60, for a purpose which will be hereinafter further evident. When the various grid modules 34, 34 are assembled within the table base 25, the walls 50, 50 thereof cooperate to define continuous partitions which extend transversely of the table base between the side walls 30, 30, the bottom wall 28 and bristle block supporting surface 36. Thus, the various grid modules 34, 34 cooperate with the table base 25 to define the individual vacuum chambers 26, 26. Various valving arrangements may be used to control zoning of the vacuum table. However, if slide valves such as the illustrated valves 37, 37 are utilized there will be no legs on the grid plate in the immediate vicinity of the various valves. Instead, a suitable bridging support structure (not shown) may be provided to support portions of the grid plate immediately above the various valves. Alternatively, vacuum control valves may be associated with one or both side walls of the table to avoid the necessity of modifying the grid structure.

Figure 6:
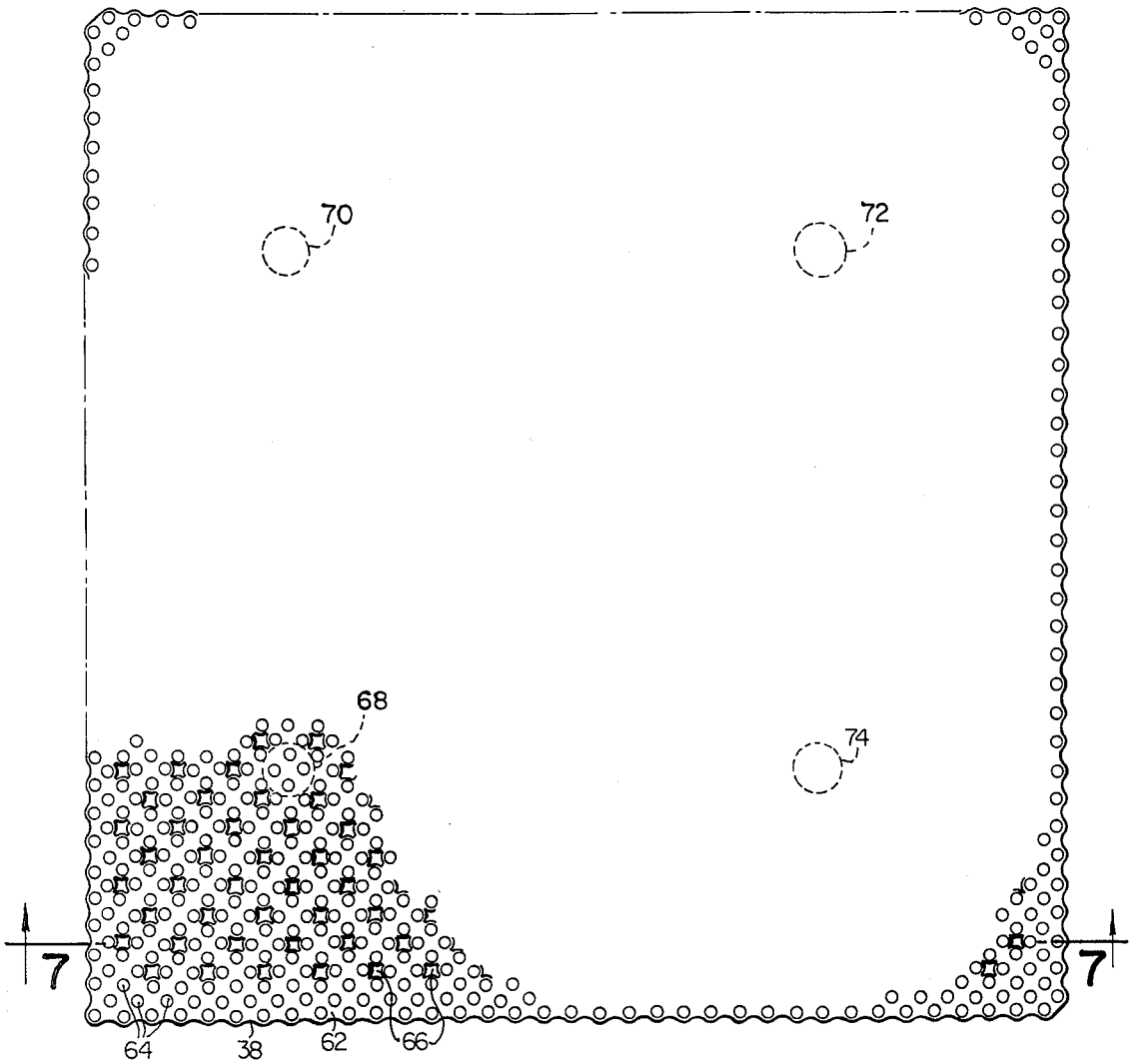
FIG. 6 is a somewhat enlarged plan view of a bristle block.
Figure 8:
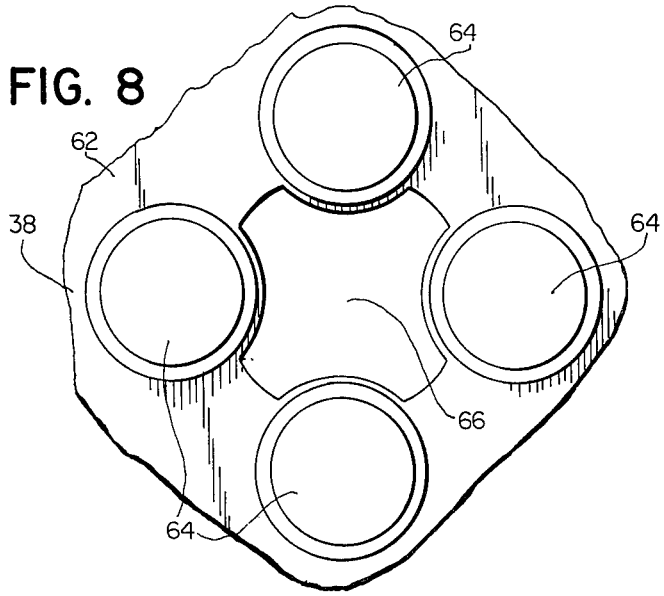
FIG. 8 is a somewhat further enlarged fragmentary plan view of the bristle block of FIGS. 6 and 7.
Figure 7:
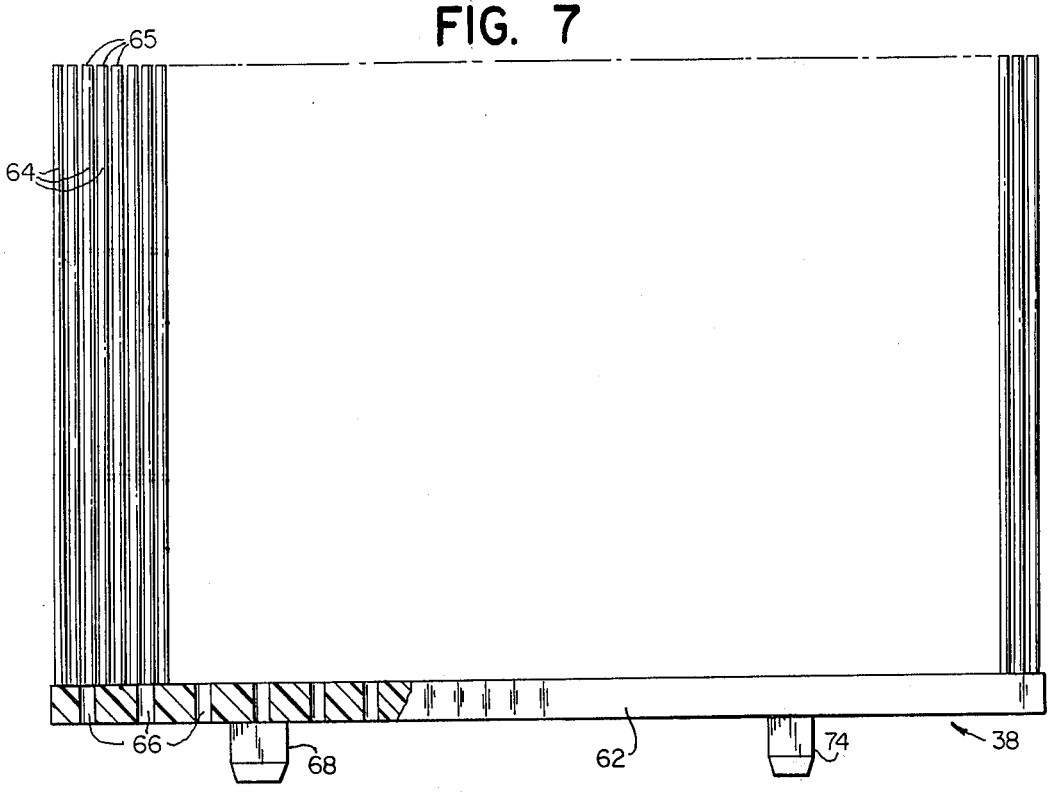
FIG. 7 is a sectional view taken along the line 7—7 of FIG. 6.

Referring now particularly to FIGS. 6–8, a typical bristle block 38 is preferably molded from plastic material such as polypropolene and includes a base portion 62 and a multiplicity of individual bristles 64, 64 which are integrally connected to the base portion and project upwardly therefrom. The bristles may be either straight or tapered, however, each bristle 64 is generally cylindrical and slightly tapered upwardly from its base toward its free end. The free end or head of each bristle 64 has a flat end surface 65. The bristles 64, 64 are uniformly distributed on the base 62 and are preferably connected thereto in generally parallel rows, each row being offset from the next adjacent row, substantially as shown in FIG. 6. A multiplicity of apertures or passageways 66, 66 are formed in the base portion. Each passageway 66 is formed in the center of an associated cluster of four bristles 64, 64. A portion of each passageway 66 generally complements an associated portion of the base of each of the four bristles which comprise the cluster so that each passageway 66 has a generally cruciform shape, as viewed from above and as best shown in FIG. 8. This configuration permits maximum air porting without substantial sacrifice of bristle strength or bristle density. The marginal edge portions of the base portion 62 are scalloped to generally conform to the contour of the bristle bases, as viewed from above and as best shown in FIG. 4.

Four connector posts 68, 70, 72 and 74 project downwardly from the base portion 62 and are adapted for press fit engagement within the apertures 54, 56, 58 and 60, respectively, associated with one of the grid sections S. The connector post 63 comprises a locator post and is adapted for press fit engagement within the aperture 54 which is designated a locator aperture. The remaining apertures 56, 58 and 60 of the grid module are constructed and arranged to compensate for variations in tolerance in the size and location of the other connector posts, as may result from normal shrinkage of the molded bristle block 33 in manufacture.

Figure 9:
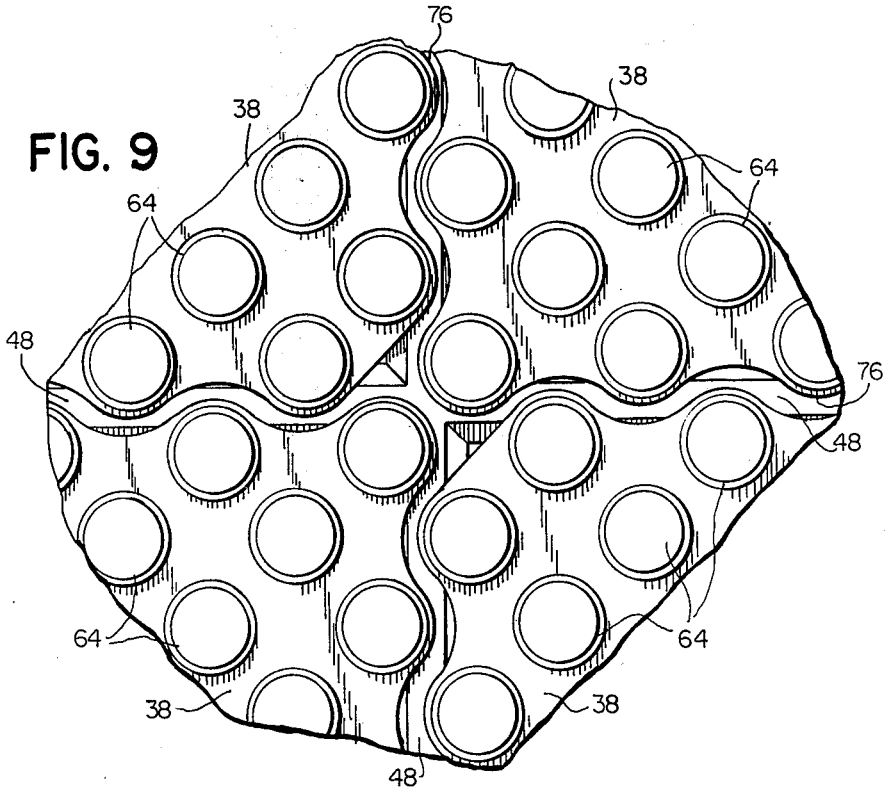
FIG. 9 is a somewhat enlarged fragmentary plan view of the bristle bed of FIG. 4.

When the bristle blocks 38, 38 are assembled in press fit relation with the grid plate 33 each passageway 66 communicates with an aperture in the grid plate. In assembly the scalloped marginal edge portions of the various bristle blocks are disposed in closely spaced generally interlocking relation, as best shown in FIG. 9. The spaces between the scalloped marginal edge portions of adjacent bristle blocks define air openings or serpentine slots such as the slot indicated at 76 in FIG. 9. The serpentine slots 76, 76 cross back and forth over the relatively narrow lands 49, 49 which support the marginal edges of the various bristle blocks, so that each slot 76 cooperates with an associated land 49 to define an alternate series of air passageways at one and the opposite sides of the land. The latter passageways communicate with an associated vacuum chamber 26 below the grid plate. The scalloped marginal portions of the bristle blocks permit the blocks to be arranged in closely spaced adjacent relation to maintain a substantially uniform bristle pattern and density throughout the bed while providing additional passageways between the blocks for increased airflow without sacrificing bristle strength or bristle density.

Figure 2:
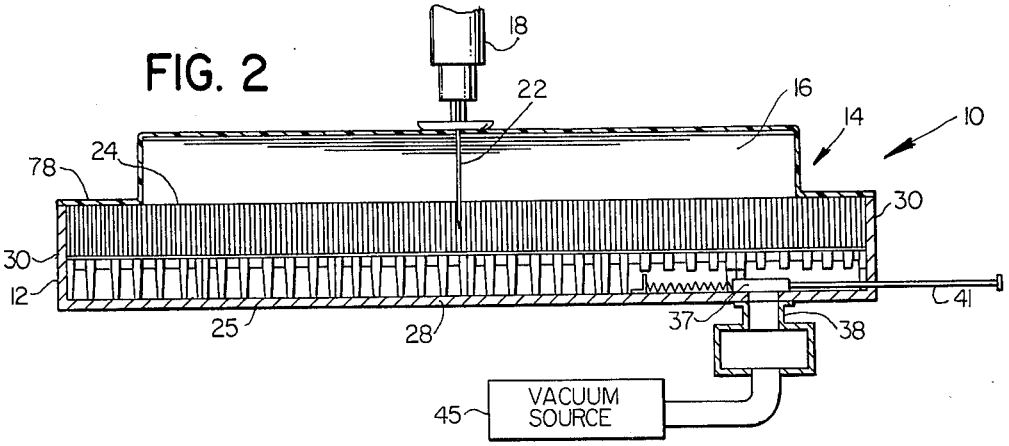
FIG. 2 is a somewhat enlarged fragmentary sectional view taken along the line 2—2 of FIG. 1.
Figure 3:
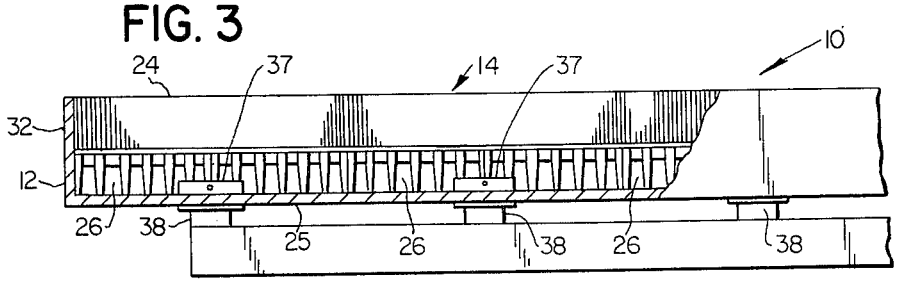
FIG. 3 is a somewhat enlarged fragmentary sectional view taken along the line 3—3 of FIG. 1.

The apparatus 10, as shown in FIGS. 1 and 2, is set up to cut a layup 16 which comprises a stack of porous fabric sheets supported on the work surface 24. A sheet of nonpermeable plastic material indicated at 78 is spread over the upper surface of the layup and portions of the bed 14 which surround the layup, as is well known in the art. As the carriage 20 travels in the X-direction to move the cutting mechanism 18 over the table in response to signals received from the programmed controller, the valve actuator 43 successively engages each actuating rod 41 in its path to open the slide valve 37 associated therewith which connect each successive vacuum chamber 26 to the vacuum source 45. Thus, as the cutting operation proceeds the layup 14 is held in fixed position on the work surface 24 by the vacuum zone in the table region in which the cutting mechanism 18 is operating. The densely arranged flat headed bristles resist lateral deflection and support the layup without the occurrence of undesirable valleys within the bristle bed. As the cutting operation progresses, a cut is formed in the nonpermeable plastic layer through which air may enter. However, air entering the cut flows downwardly between the bristles in a path generally parallel to the bristles which do not substantially impede airflow. Vacuum loss in the vicinity of the cut is minimal so that hold-down pressure is maintained in the vicinity of the cutting blade.

Another vacuum table embodying the present invention and indicated generally at **12*a* is shown in FIGS. 10 and 11. Parts of the table 12*a* which correspond to parts of the previously described vacuum table 10 bear the same numeral as the previously described part with a letter "a" suffix. The vacuum table 12*a* has a base 25*a* and a bristle bed indicated generally at 14*a* which includes a grid plate 33*a* and a bristle mat formed from a plurality of individual bristle blocks 38*a*, 38*a* releasably supported on the grid plate. More specifically, the bristle mat is formed from a patchwork of relatively small bristle blocks 38*a*, 38*a*, the surface area of each block, as defined by the free ends of its bristles, being relatively small as compared with the overall surface area of the bristle bed 14*a***.

As in the previously described embodiment, grid modules **34*a*, 34*a* comprise the grid plate 33*a* and are arranged in end-to-end relation within the table base 25*a*. A typical grid module, as shown in FIGS. 10 and 11, comprises a unitary structure which is preferably molded from plastic material. It includes a generally rectangular frame upon which is supported an integral latticework of intersecting bars 46*a*, 46*a*, which define an upwardly facing supporting surface 36*a*. A plurality of integral legs 48*a*, 48*a* project downwardly from various points of intersection of the bars 46*a*, 46*a* to support the grid plate 33*a* on the bottom wall 28*a*, a skirt or wall 50*a* which comprises one side wall of the rectangular grid frame extends between the upper surface 36*a* and the lower ends of the various legs. Each grid module 34*a* is adapted to support and retain a group of sixteen individual bristle blocks 38*a*, 38*a* and has sixteen non-circular upwardly opening connector receiving apertures as indicated at 54*a*, 54*a* in FIG. 10. The various grid modules 34*a*, 34*a* are assembled within the table base 25*a* so that the walls 50*a*, 50*a* thereof form continuous partitions which extend transversely of the table base between the base side walls 30*a*, 30*a*** (one shown). Thus, the grid modules are arranged to cooperate with the table base to define a plurality of vacuum chambers within the table base.

A typical molded bristle block **38*a* is illustrated in FIGS. 12 and 13 and includes a base portion 62*a* and a multiplicity of bristles 64*a*, 64*a* which are integrally connected to the base portion and project upwardly therefrom. Preferably and as shown, each bristle 64*a* is a straight or cylindrical bristle which has a uniform circular cross-section throughout its length. As in the previously described embodiment, the head or free end of each bristle is defined by a substantially flat radially disposed surface 65*a*. The bristles 64*a*, 64*a* are uniformly distributed on the base portion 62*a* and are arranged in generally parallel rows, as shown in FIG. 12. The base portion 62*a* is substantially imperforate and generally rectangular, as viewed from above. Preferably, and as shown, the outermost rows of bristles are located immediately adjacent the marginal edges of the base portion, as best shown in FIG. 12. A connector post 68*a* projects downwardly from the lower surface of the base portion 62*a* and has a non-circular cross-section to generally complement the cross-sectional configuration of an aperture 54*a*** in which it is received.

The grid modules **34*a*, 34*a* are dimensioned so that the bristle blocks 38*a*, 38*a* assembled therewith are spaced apart a distance substantially equal to the distance between adjacent rows of bristles. Thus, narrow air openings or slots 76*a*, 76*a* are formed between the marginal edges of adjacent bristle blocks. The slots 76*a*, 76*a* communicate with various apertures in the grid modules 34*a*, 34*a* which support the blocks so that a network of relatively closely spaced parallel slots 76*a*, 76*a* are formed which provide airflow passageways through the base of the bristle mat which comprises the bristle bed 12*a* while maintaining a substantially uniform bristle pattern throughout the bed 12*a*. The latter airflow passageways communicate with the various vacuum chambers in the base of the zoned table 12*a***.

The bristle bed arrangement hereinbefore described, which utilizes relatively small bristle blocks, facilitates bed repair at minimal expense. Thus, if repeated cutting of a pattern within a relatively limited region of the bed results in damage to bristle blocks in that region only those blocks which are damaged need to be replaced. Further, the relatively closely spaced network of slots **76*a*, 76*a* formed between the small blocks provides ample airflow downwardly through the bristle bed 14*a*** to assure efficient compacting and rigidizing of most fabrics and like materials to be worked.

Figure 14:
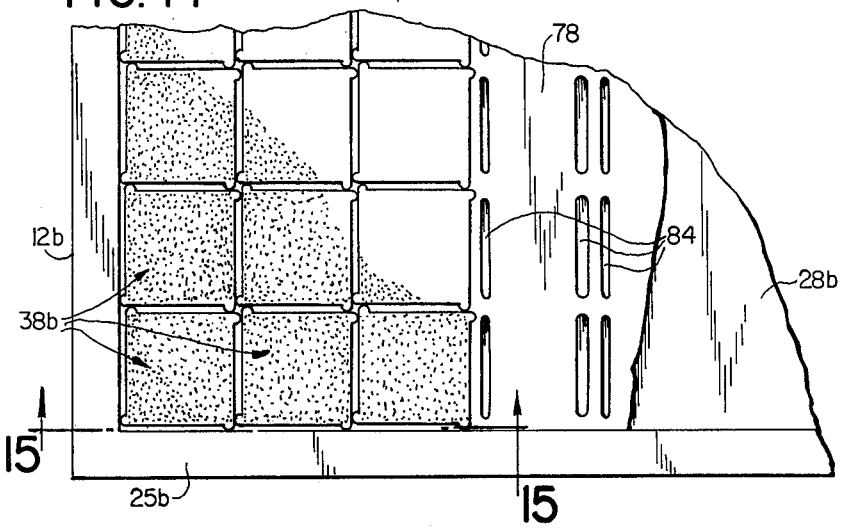
FIG. 14 is a fragmentary plan view of still another vacuum table embodying the present invention.
Figure 15:
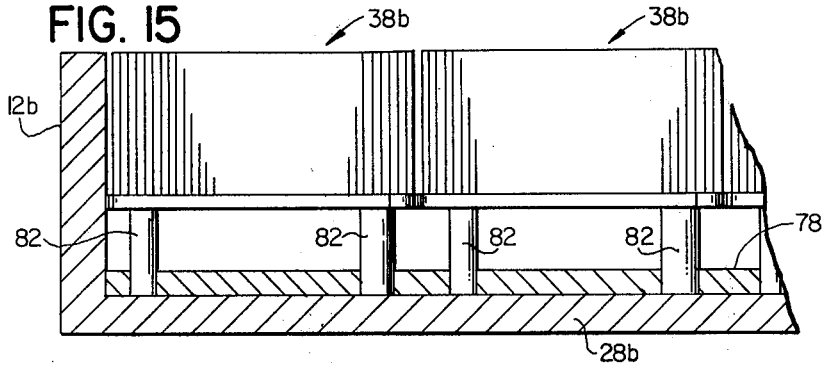
FIG. 15 is a somewhat enlarged sectional view taken along the line 15—15 of FIG. 14.

FIGS. 14 and 15 illustrate still another vacuum table embodying the present invention and indicated generally by the numeral 12*b*. However, the vacuum table 12*b* differs from the ones previously described in that the various bristle blocks 38*b*, 38*b* which comprise the bed are substantially self-supporting which eliminates the need for a supporting grid structure. The table 12*b* has a base 25*b* which contains the bed 14*b*. It may also include means for releasably retaining the various bristle blocks 38*b*, 38*b*, such as a retaining plate 78 which will be hereinafter further discussed. The retaining plate 78 has no counterpart in the previously described structures.

Figure 16:
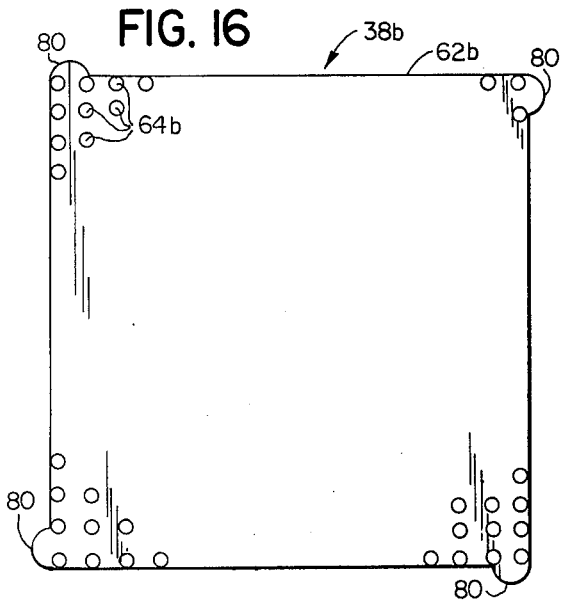
FIG. 16 is a somewhat further enlarged plan view of a typical bristle block of the vacuum table of FIG. 14.
Figure 17:
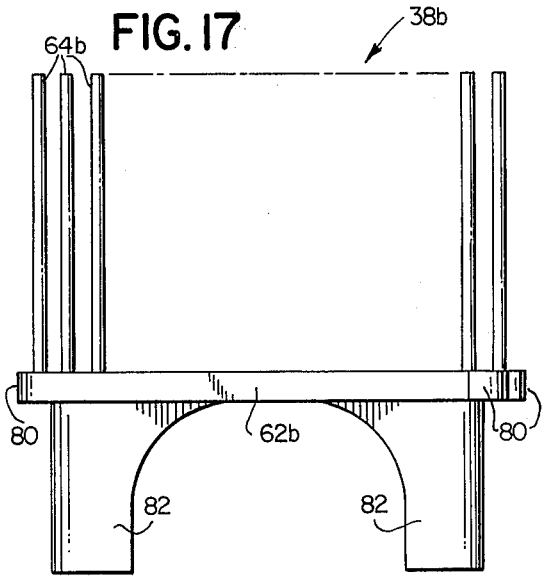
FIG. 17 is an end elevational view of the bristle block of FIG. 16.

Before further considering the construction of the bristle bed 14*b*, a typical bristle block 38*b* will be described. Referring now particularly to FIGS. 16 and 17, a typical bristle block 38*b* is molded from plastic material and includes a generally rectangular base portion 62*b*. Bristles 64*b*, 64*b* are integrally connected to the upper surface of the base portion and project upwardly therefrom. The various bristles 64*b*, 64*b*, as illustrated, are substantially straight bristles of regular cylindrical form arranged in uniform parallel rows on the base portion 62*b*. The outermost rows of bristles are arranged immediately adjacent the peripheral edges of the base portion, substantially as shown in FIG. 16. Small projections 80, 80 extend outwardly from four corners of the base portion, as shown. Each projection 80 extends outwardly beyond an associated peripheral edge of the base portion a distance substantially equal to the diameter or thickness of one bristle 64*a*.

A plurality of spaced apart support members 82, 82 project downwardly from the lower surface of the base portion 62*a* to support the base portion on the bottom wall 28*a* and in vertically spaced relation thereto. The illustrated retaining plate 78 has a plurality of apertures or slots 84, 84 which receive the lower end portions of the various support members 82, 82 in press fit engagement therein so that the plate 78 locates and releasably retains the various bristle blocks in assembly with the base 25*b*. When the bristle blocks 38*b*, 38*b* are assembled within the base 25*b*, generally as shown in FIG. 14, the various projections 80, 80 engage associated peripheral surface portions of adjacent blocks so that the blocks are maintained in closely adjacent spaced relation to define a network of air openings or slots 76*b*, 76*b* the width of each slot being substantially equal to the distance between adjacent rows of bristles so that a substantially uniform bristle pattern is maintained throughout the bed 12*b*. Thus, air passageways are formed between the various bristle blocks which comprise the bristle bed or mat, the latter air passageways being in communication with one or more vacuum chambers generally defined by the bases of the bristle blocks and the table base 25*b*. If the table 12*b* is to be zoned, suitable partitions may be provided in the lower portion of the table base 25*b* to extend transversely of the base. Suitable apertures may be formed in the retaining plate 78 to cooperate with projections on the partitions whereby to locate and retain such partitions as may be required to produce the desired vacuum zones.

I claim:

1. A unitary bristle block made from plastic material and having a base, a multiplicity of flexible bristles integrally connected to one side of said base and projecting in parallel relation therefrom, said bristles having free ends defining a substantially planar support surface, each of said bristles having a taper converging from one end toward its opposite end, a plurality of parallel connecting posts integrally connected to said base and projecting from the side thereof opposite said one side, said base having a plurality of passageways extending therethrough, each of said passageways opening through said one side between a plurality of said bristles.

2. A unitary bristle block as set forth in claim 1 wherein said opposite end comprises the free end of said bristle.

3. A unitary bristle block as set forth in claim 2 wherein said free end has a substantially flat surface.

4. A unitary bristle block as set forth in claim 1 wherein said base has a scalloped peripheral edge.

5. A bristle bed for a vacuum holddown apparatus, said bristle bed comprising a bristle mat including a plurality of bristle blocks each having a base portion and a plurality of flexible bristles projecting from said base portion, means for supporting said bristle blocks with the base portions thereof disposed in a common plane to define a mat base and with the free ends of said bristles disposed in another common plane to define a support surface, and means for maintaining associated marginal edge portions of said base portions of adjacent bristle blocks in spaced apart relation to each other to define openings through said mat base between said bristles.

6. A bristle bed as set forth in claim 5 wherein said supporting means comprises a grid and said bed includes means for releasably retaining said bristle blocks in assembly with said grid with said openings in communication with apertures in said grid.

7. A bristle bed as set forth in claim 6 wherein said maintaining means comprises means for releasably retaining said bristle blocks in assembly with said grid.

8. A bristle bed as set forth in claim 7 wherein each of said bristle blocks has a scalloped peripheral edge and said openings comprise serpentine slots.

9. A bristle bed as set forth in claim 5 wherein said bristles project from one side of said base and said retaining means comprises posts projecting from the opposite side of said base and received in apertures in said grid.

10. A bristle bed as set forth in claim 5 wherein each of said bristles has a taper.

11. A bristle block as set forth in claim 5 wherein each of said bristles has a taper which converges toward its free end.

12. A bristle bed as set forth in claim 5 wherein each of said bristles is of substantially uniform cross-section throughout its length.

13. A bristle bed as set forth in claim 5 wherein said bristles project from one side of said base portion and said supporting means comprise a plurality of support members which project from the side of said base portion opposite said one side.

14. A bristle bed as set forth in claim 5 wherein each of said base portions has a plurality of passageways therethrough.

15. A bristle bed as set forth in claim 14 wherein each of said passageways has a cruciform cross-sectional configuration and is partially defined by passageway walls which generally complement associated peripheral surface portions of the bases of associated bristles adjacent one end of the passageway.

16. A bristle block comprising a base having a scalloped peripheral edge, a multiplicity of flexible bristles projecting in spaced apart relation from one side of said base, said bristles having free ends defining a support surface, said base having a plurality of passageways therethrough and opening through said one side between said bristles.

17. A bristle block as set forth in claim 16 further characterized by said block comprising a unitary block of molded plastic material.

18. A bristle block as set forth in claim 16 wherein each of said bristles has a taper.

19. A bristle block as set forth in claim 16 wherein each of said bristles has a taper which converges toward its free end.

20. A bristle block as set forth in claim 16 including a plurality of parallel connecting posts projecting from the other side of said base.

21. A bristle block as set forth in claim 16 wherein each of said free ends has a substantially flat end surface.

22. A bristle block as set forth in claim 16 wherein each of said bristles has a substantially uniform cross-section throughout its length.

23. A bristle block as set forth in claim 16 wherein each of said passageways has a generally cruciform cross-sectional configuration.

24. A bristle block comprising a base, a multiplicity of flexible bristles projecting in spaced apart relation from one side of said base, said bristles having free ends defining a support surface, said base having a plurality of passageways therethrough opening through said one side between said bristles, and a plurality of connecting posts projecting from the other side of said base opposite said one side.

25. A bristle bed for a vacuum apparatus for holding down fabric and the like while being worked, said bristle bed comprising a bristle mat including a plurality of bristle blocks each having a base portion and a plurality of flexible bristles projecting from said base portion, a grid supporting said bristle blocks with the base portions thereof disposed in a common plane to define a mat base and with the free ends of said bristles disposed in another common plane to define a support surface, means defining openings through said mat base between said bristles, and means for releasably retaining said bristle blocks in assembly with said grid with said openings in communication with apertures in said grid.

26. A bristle bed as set forth in claim 25 wherein said retaining means comprises means for releasably retaining said bristle blocks in assembly with said grid with adjacent blocks in closely spaced relation and wherein spaces between said adjacent blocks comprise said openings.

27. A bristle bed as set forth in claim 26 wherein each of said bristle blocks has a scalloped peripheral edge and said spaces comprise serpentine slots.

28. A bristle bed as set forth in claim 25 wherein said bristles project from one side of said base and said retaining means comprises posts projecting from the opposite side of said base and received in openings in said grid.

29. A bristle block comprising a base having a scalloped peripheral edge, a multiplicity of flexible bristles projecting in spaced apart relation from one side of said base, said bristles having free ends defining a support surface, and a plurality of parallel connecting posts projecting from the other side of said base.

30. A bristle block comprising a base, a multiplicity of flexible bristles projecting in spaced apart relation from one side of said base, said bristles having free ends defining a support surface, said base having a plurality of passageways therethrough opening through said one side between said bristles, and at least one connecting post projecting from the other side of said base opposite said one side.

31. A bristle block as set forth in claim 30 wherein said one connecting post has a non-circular cross-section.

32. In a vacuum apparatus for holding down sheet material and the like while being worked, a bristle bed comprising a bristle mat including a plurality of bristle blocks each having a base portion and a plurality of flexible bristles projecting from said base portion, a support member having apertures therethrough and supporting said bristle blocks with the base portions thereof disposed in a common plane to define a mat base and with the free ends of said bristles disposed in another common plane to define a material supporting surface, means defining openings through said mat base between said bristles, and means for releasably retaining said bristle blocks in assembly with said support member with said openings in communication with apertures in said support member.

* * * * *